US008435011B2

(12) United States Patent
Rohl

(10) Patent No.: US 8,435,011 B2
(45) Date of Patent: May 7, 2013

(54) INTEGRATED COMPRESSOR AND PUMP UNIT AND VEHICLES EQUIPPED THEREWITH

(75) Inventor: Jeffrey Scott Rohl, Three Oaks, MI (US)

(73) Assignee: Vanair Manufacturing Inc., Michigan City, IN (US)

( * ) Notice: Subject to any disclaimer, the term of this patent is extended or adjusted under 35 U.S.C. 154(b) by 267 days.

(21) Appl. No.: 12/776,078

(22) Filed: May 7, 2010

(65) Prior Publication Data

US 2011/0116944 A1 May 19, 2011

Related U.S. Application Data

(60) Provisional application No. 61/176,616, filed on May 8, 2009.

(51) Int. Cl.
*F04B 17/05* (2006.01)
*F00B 23/08* (2006.01)

(52) U.S. Cl.
USPC ..... 417/231; 417/364; 417/199.1; 123/198 C

(58) Field of Classification Search ..... 417/364, 417/360, 361, 199.1, 319, 231; 123/198 C
See application file for complete search history.

(56) References Cited

U.S. PATENT DOCUMENTS

| | | | | |
|---|---|---|---|---|
| 3,037,455 | A * | 6/1962 | Bozimowski et al. | 418/3 |
| 3,216,104 | A * | 11/1965 | O'Shields | 29/469 |
| 3,788,769 | A * | 1/1974 | Glass et al. | 417/26 |
| 4,512,728 | A * | 4/1985 | Nakano et al. | 418/3 |
| 5,096,389 | A * | 3/1992 | Grady | 417/364 |
| 5,242,278 | A * | 9/1993 | Vanderslice et al. | 417/364 |
| 5,465,804 | A * | 11/1995 | Malik | 180/406 |
| 5,497,742 | A * | 3/1996 | Plantan | 123/197.5 |
| 5,997,260 | A * | 12/1999 | Genter et al. | 417/364 |
| 7,257,948 | B1 * | 8/2007 | Bennett | 60/486 |
| 2008/0245637 | A1 * | 10/2008 | Fetter et al. | 192/66.2 |
| 2011/0135510 | A1 * | 6/2011 | Mellar et al. | 417/319 |

FOREIGN PATENT DOCUMENTS

GB 1494009 A * 12/1977

* cited by examiner

*Primary Examiner* — Devon Kramer
*Assistant Examiner* — Nathan Zollinger
(74) *Attorney, Agent, or Firm* — Hartman Global IP Law; Gary M. Hartman; Domenica N. S. Hartman

(57) ABSTRACT

An integrated compressor and pump unit suitable for installation on a vehicle and draw rotary power from a power source of the vehicle. The unit includes a compressor unit and a separate pump unit. The compressor unit has a rotary input shaft coupled to a rotary compressing device of the compressor unit. The pump unit is mounted to the compressor unit and has a rotary input shaft coupled to a rotary pumping device of the pump unit. The pump unit is secured to the compressor unit and rotary motion is transferred from the rotary input shaft of the compressor unit to the rotary input shaft of the pump unit such that the rotary compressing and rotary pumping devices operate in unison and in series.

20 Claims, 4 Drawing Sheets

INTEGRATED COMPRESSOR AND PUMP UNIT AND VEHICLES EQUIPPED THEREWITH

CROSS REFERENCE TO RELATED APPLICATIONS

This application claims the benefit of U.S. Provisional Application No. 61/176,616, filed May 8, 2009, the contents of which are incorporated herein by reference.

BACKGROUND OF THE INVENTION

The present invention generally relates to equipment adapted for installation on a vehicle, and more particularly to an integrated compressor and pump unit adapted to be powered by a single power input shaft that draws power from an engine of a vehicle, for example, a power take-off (PTO) shaft of a utility, service, emergency or military vehicle.

Utility vehicles, service and emergency vehicles are often equipped with pneumatic systems, and therefore benefit from an on-board air compressor. Such air compressors may be powered by a PTO shaft driven by the engine of the vehicle. As with other fluid systems that deliver and contain a fluid at a high pressure or flow rate, the output of such an air compressor is preferably regulated at a prescribed level deemed safe and appropriate for the intended use of the compressed air. Certain utility vehicles, service, emergency and military vehicles also may utilize other equipment, including power generators and fluid pumps. A nonlimiting example is a compressed air foam system (CAFS) of an emergency vehicle equipped to fight fires with a fire retardant foam. In such a system, a water pumping system may be used in combination with an air compressor, the latter of which is plumbed to introduce compressed air into water pumped by the water pumping system, which in turn contains a foam solution to generate a fire retardant foam.

Compressors, pumps, generators, and other equipment are typically independently mounted in vehicles. For example, power generators and compressors are often independently mounted in separate locations beneath a vehicle frame, requiring power from the vehicle engine to be transmitted by drive shafts or belts to these locations. A notable exception is a combined power generator and air compressor disclosed in U.S. Pat. No. 5,242,278 to Vanderslice et al., which combines a generator and compressor into a single unit to reduce clutter within the vehicle undercarriage and mechanical inefficiencies.

BRIEF DESCRIPTION OF THE INVENTION

The present invention provides an integrated compressor and pump unit suitable for installation on a vehicle and adapted to draw rotary power from a power source of the vehicle.

According to a first aspect of the invention, the integrated compressor and pump unit includes a compressor unit and a separate pump unit. The compressor unit comprises a compressor housing, rotary compressing means within the compressor housing for compressing air, a rotary input shaft coupled to the rotary compressing means and protruding from a first end of the compressor housing, and means for coupling the rotary input shaft to the power source of the vehicle. The pump unit is mounted to a second end of the compressor housing opposite the first end thereof so as to define an interface between the compressor and pump units. The pump unit comprises a pump housing, rotary pumping means within the pump housing for pumping a fluid, and a rotary input shaft coupled to the rotary pumping means. The integrated compressor and pump unit further comprises means for securing the pump housing of the pump unit to the compressor housing of the compressor unit, means located at the interface for transferring rotary motion of the rotary input shaft of the compressor unit to the rotary input shaft of the pump unit such that rotation of the coupling means directly causes rotation of the rotary input shaft of the compressor unit, compression of air by the rotary compressing means, rotation of the rotary input shaft of the pump unit, and pumping of a fluid by the rotary pumping means, and means for fluidically sealing a compressed fluid within the compressor unit and fluid within the pump unit at the interface therebetween.

Other aspects of the invention include vehicles on which the integrated compressor and pump unit is installed, including but not limited to utility, service, emergency and military vehicles.

In view of the above, it can be seen that a significant advantage of this invention is that the compressor and pump units are part of an integrated unit that can be installed as a unitary and complete assembly on a vehicle. The integrated compressor and pump unit can be coupled to a suitable power source, such as the vehicle's engine, via a power take-off shaft to which the coupling means is connected, such that rotation of the power take-off shaft drives the rotary input shafts of the compressor and pump units in series, with the result that the compressor and pump units are simultaneously operated by the vehicle's engine. Alternatively, the integrated compressor and pump unit may be driven by a power source other than the engine, for example, a hydraulic motor or an auxiliary engine. In any case, the mounting of the pump unit in series (in-line) with the compressor unit makes efficient use of available space, for example the undercarriage space, of a vehicle.

Other aspects and advantages of this invention will be better appreciated from the following detailed description.

DETAILED DESCRIPTION OF THE INVENTION

Figure 1:
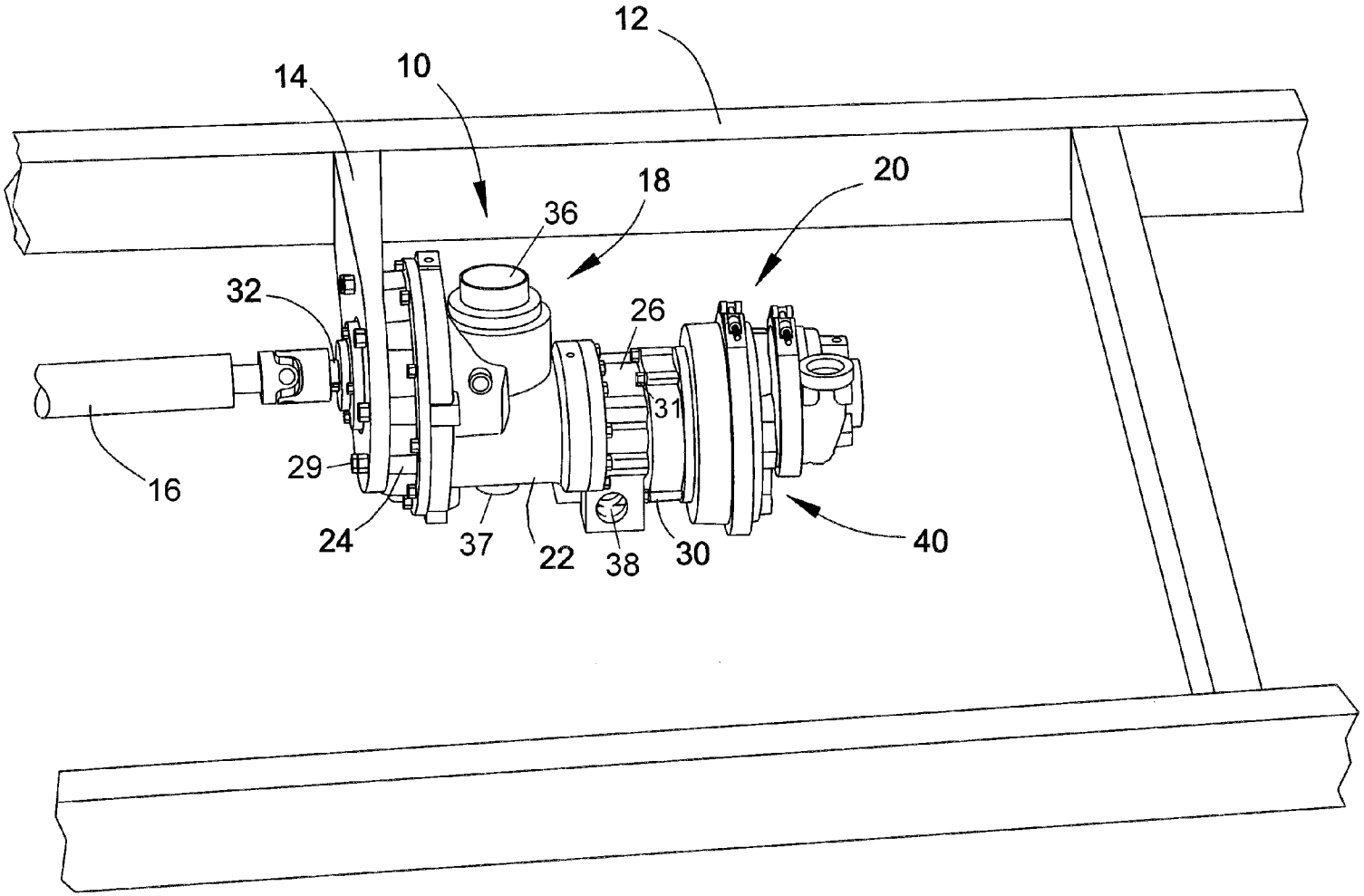
FIG. 1 is a fragmentary perspective view representing an integrated compressor and pump unit mounted to the undercarriage of a vehicle and coupled to a power take-off shaft of the vehicle in accordance with an embodiment of this invention.
Figure 4:
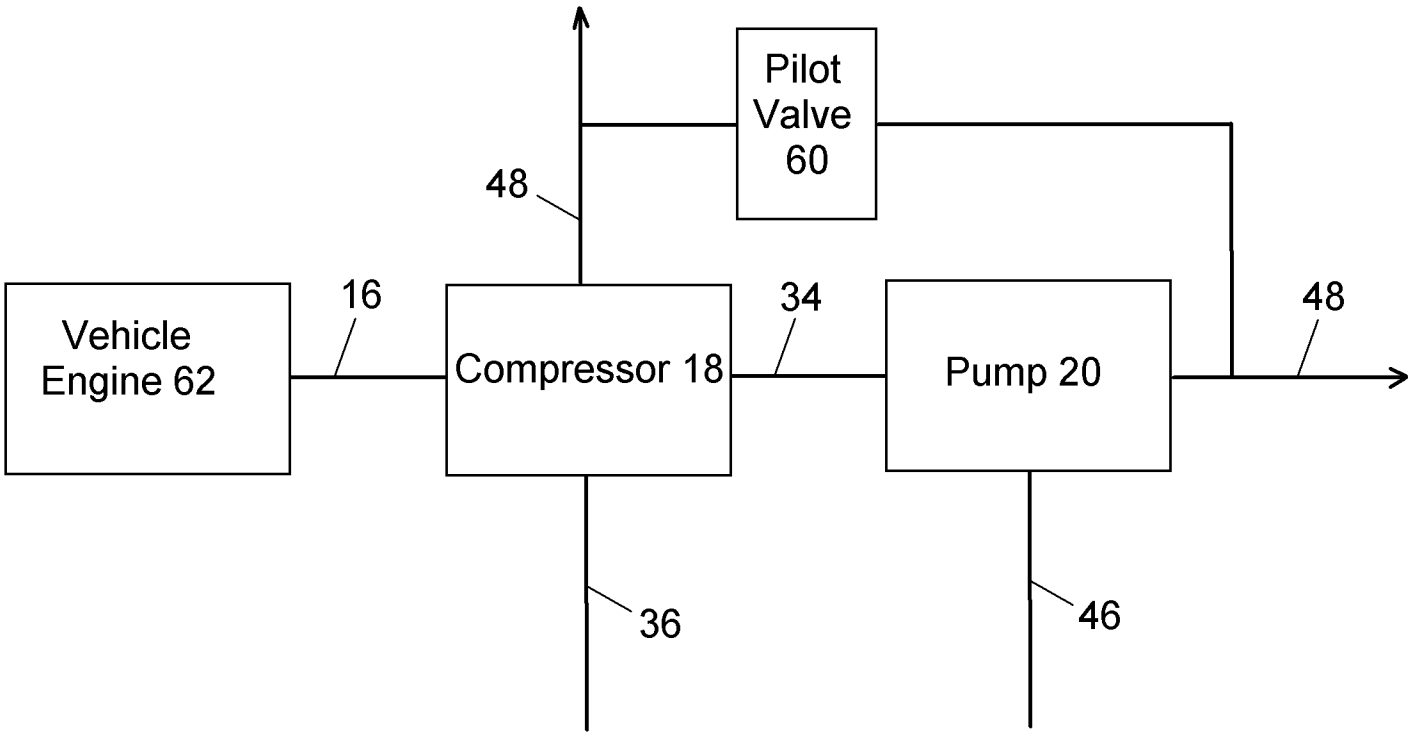
FIG. 4 schematically represents a particular application for the integrated compressor and pump unit of FIG. 1.

FIG. 1 represents an integrated compressor-pump unit 10 installed on the undercarriage 12 of a vehicle in accordance with an embodiment of the invention. The vehicle can be of a variety of types, including but not limited to utility, service, emergency and military vehicles, as well as vehicles used in such applications as construction (for example, cranes), sewer, infrastructure, rehabilitation, mining, petrochemical, military, spray foam, lubrication, decontamination and water canons. Particular examples of emergency vehicles include mechanical, fire and rescue vehicles, including those equipped with compressed air foam systems (CAFS). The unit 10 is shown mounted on one side of a flange 14 secured to the undercarriage 12, with a power take-off (PTO) shaft 16 extending toward the unit 10 on the opposite side of the flange 14. The unit 10 can be directly coupled to the shaft 16, or indirectly coupled to the shaft 16 via another shaft, gearbox, belt drive or hydraulic unit, as would be well understood by those skilled in the art. FIG. 4 schematically represents the shaft 16 as driven by an engine 62 of a vehicle, though it is also within the scope to use the unit 10 apart from a vehicle, such as a standalone unit. Finally, it is also within the scope of the invention that the shaft 16 could be directly driven off the transmission (not shown) of the engine 62.

Figure 2:
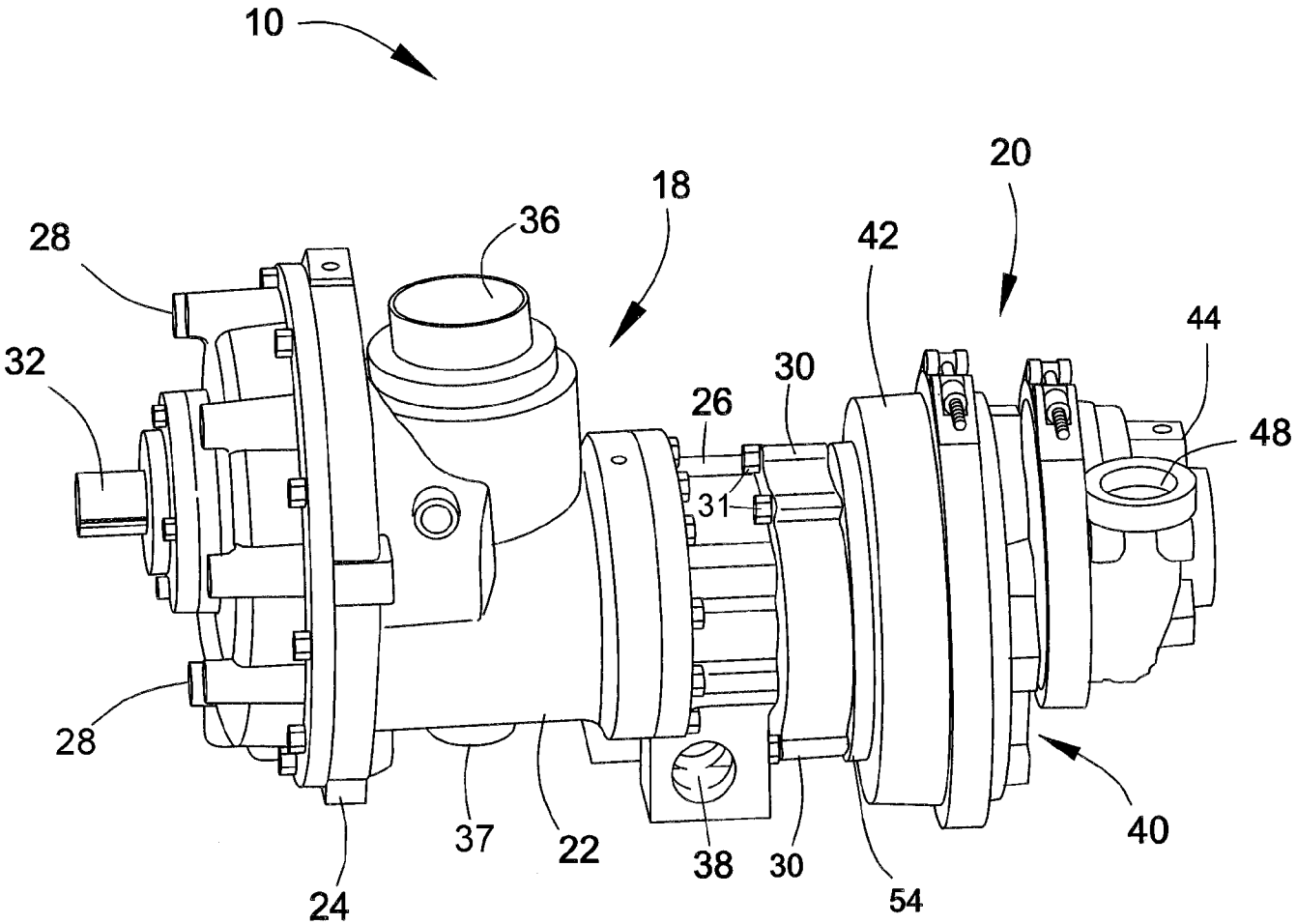
FIG. 2 represents an isolated view of the integrated compressor and pump unit of FIG. 1.
Figure 3:
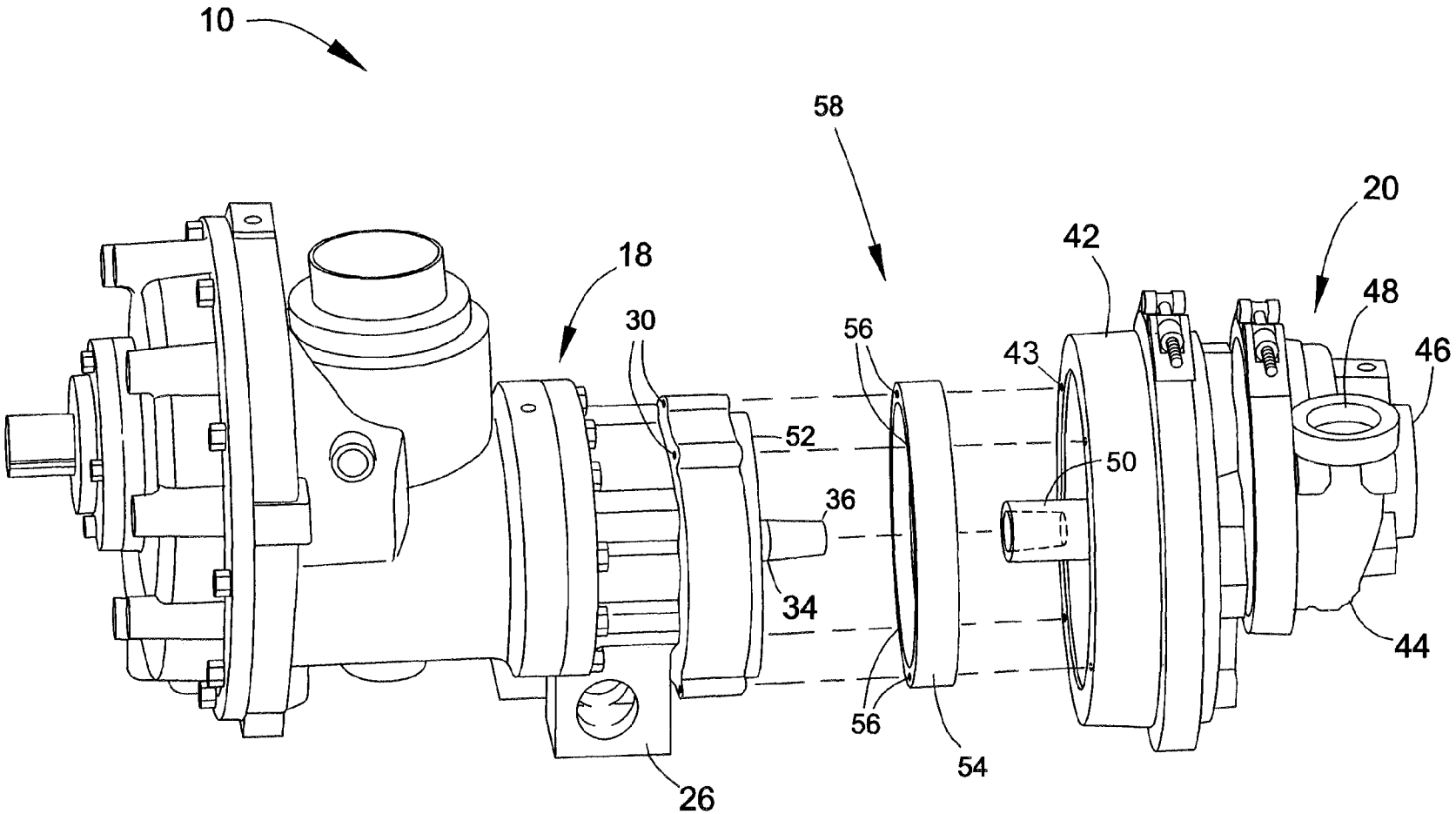
FIG. 3 represents an exploded view of the integrated compressor and pump unit of FIG. 1.

The unit 10 is shown in FIGS. 1 through 3 as comprising a compressor 18 and a pump 20 mounted and operably connected in series. The compressor 18 can be of any particular desired type for the purpose of compressing a compressible fluid, such as air. A notable example is a dual rotary screw air compressor commonly used as vehicle-mounted air compressors, commercial examples of which include various models available from Vanair Manufacturing, Inc. The compressor 18 generally comprises a housing assembly 22 in which the internal components (not shown) of the compressor 18 are contained. The housing assembly 22 includes housings 24 and 26 located at opposite ends thereof, as well as an air inlet port 36, an oil inlet port 37, and an air/oil discharge port 38. The discharge port 38 is located on the housing 26 and adapted for coupling to a high pressure air line (not shown) or other suitable conduit. As such, the housing 26 is referred to herein as a discharge housing 26 of the compressor 18. The opposite housing 24 may, in certain embodiments, contain gearing to enable internal rotary components (not shown) of the compressor to rotate at different speeds than the shaft 16, and as such the housing 24 will be referred to as the gear housing 24 of the compressor 18. The gear and discharge housings 24 and 26 can be further used to house bearings that support the internal rotary components of the compressor 18, such as a pair of rotary screws if the compressor 18 is a rotary screw air compressor. In addition, the gear housing 24 is adapted for mounting the compressor 18 to the undercarriage flange 14 (or any other suitable mounting surface), and the discharge housing 26 is adapted for mounting the pump 20 to the compressor 18, as will be discussed in more detail below. For the purpose of providing their respective mounting capabilities, the gear and discharge housings 24 and 26 can be formed to contain bores 28 and 30, respectively, to permit bolting of the housing assembly 22 to the flange 14 with bolts 29 and bolting the pump 20 to the compressor 18 with bolts 31, as shown in FIGS. 1 and 2 and evident from FIG. 3.

As also seen in FIGS. 2 and 3, the compressor 18 is equipped with an input shaft 32 that protrudes from the gear housing 24 and may be connected to or formed as an integral extension of the compressor drive shaft, such as the rotor screw shaft. The distal end of the input shaft 32 is represented as being keyed for directly coupling to the PTO shaft 16 or a shaft driven by the PTO shaft 16. Alternatively, the input shaft 32 could be coupled to an intermediate shaft coupled to the PTO shaft 16, or a gearbox, hydraulic motor, or separate engine, etc., though it should be understood that the input shaft 32 could be configured for being driven in any other suitable manner, such as a belt drive. The compressor 18 is further equipped with an output shaft 34 that protrudes from the discharge housing 26. Similar to the input shaft 32, the output shaft 34 may be connected to or formed as an integral extension of the compressor drive shaft. The output shaft 34 is shown as having an optional tapered end 36 adapted for coupling with the pump 20, as will be discussed below.

The pump 20 can be of any particularly desired type and have essentially any power and output rating compatible with an on-vehicle installation and the intended use of the vehicle. Nonlimiting examples of suitable pump designs include radial-flow centrifugal pumps, such as an HP-100 series pump rated at 18 HP and commercially available from Vanair Manufacturing, Inc. The pump 20 generally comprises a housing assembly 40 in which the internal components (not shown) of the pump 20 are contained, such as an impeller of a radial-flow centrifugal pump. The housing assembly 40 includes a mounting plate 42 and a pump housing 44 located at opposite ends thereof. The pump housing 44 has an axial fluid inlet port 46 and a radial fluid discharge port 48 adapted for coupling to suitable fluid lines (not shown). The mounting plate 42 is adapted for mounting to the discharge housing 26 of the compressor 18, for example, with the bolts 31 that pass through the bores 30 of the discharge housing 26 and thread into threaded bores 43 formed in the surface of the mounting plate 42 facing the discharge housing 26.

As represented in FIG. 3, the tapered end 36 of the compressor output shaft 34 engages a drive shaft 50 of the pump 20 coupled to the internal pumping components of the pump 20. For example, the tapered end 36 of the output shaft 34 can be sized to frictionally fit into a coaxial tapered bore in the end of the pump drive shaft 50. Any suitable means can be employed to secure the tapered end 36 of the output shaft 34 within the tapered bore of the pump drive shaft 50, for example, a threaded stud (not shown). By coupling the drive shaft 50 of the pump 20 to the output shaft 34 of the compressor, rotary power drawn from the PTO shaft 16 is able to operate both the compressor 18 and the pump 20.

FIG. 3 shows a sealing system that fluidically seals an interface 58 of the unit 10 defined by and between the compressor 18 and pump 20. In particular, an annular-shaped seal cover 52 is shown mounted to a face of the compressor discharge housing 26 located radially interior of the bores 30 with which the pump 18 is attached to the compressor 18 with bolts (not shown). The seal cover 52 secures a sealing element (not shown) that surrounds and seals the output shaft 34 of the compressor 18. Similarly, a sealing element (not shown) surrounds and seals the input shaft 50 of the pump 20. An annular-shaped spacer plate 54 circumferentially surrounds the seal cover 52 and is sandwiched between the discharge housing 26 and mounting plate 42 of the compressor 18 and pump 20, respectively, such that the seal cover 52 is enclosed by the spacer plate 54 and the compressor and pump housings 22 and 44. Bolt holes 56 are present in the spacer plate 54 to enable the bolts 31 used to secure the pump 20 to the compressor 18 to pass through the plate 54 and position the plate 54 relative to the seal cover 52. The sealing elements surrounding the output shaft 34 of the compressor 18 and the input shaft 50 of the pump 20 ensure that the interface 58 between the compressor 18 and pump 20 is fluid-tight, namely, compressed air from the compressor 18 and pressurized fluid from the pump 20 do not enter the interface 58. The spacer plate 54 can be adapted for mounting a particular type of pump 20 to a particular compressor 18, or provided with multiple bolt patterns to enable the mounting of different pumps 18 to one or more types of compressors 18.

An exemplary but nonlimiting application for the integrated compressor-pump unit 10 described above is for use in an emergency vehicle adapted to pump water containing a foam solution, in which case the pump 20 is preferably adapted to deliver water and the compressor 18 can be used as a source for compressed air that is introduced into the water pumped by the pump 20 to generate a fire retardant foam. Such an embodiment is schematically represented in FIG. 4. The pressure of compressed air that is drawn from the compressor 18 and then introduced into the water downstream of the pump discharge port 48 can be regulated by a pilot valve assembly 60 adapted to regulate the pressure of the air compressed by the compressor 18 relative to the pressure of the water pumped by the pump 20. A particularly preferred pilot valve assembly is disclosed in commonly-assigned U.S. Pat. No. 8,162,068 to Rohl, the contents of which are incorporated herein by reference.

While the invention has been described in terms of a specific embodiment, it is apparent that other forms could be adopted by one skilled in the art. For example, the type and physical configurations of the compressor 18 and pump 20 could differ from those shown and described, and various materials and processes could be used in the fabrication and assembly of the integrated compressor-pump unit 10. Therefore, the scope of the invention is to be limited only by the following claims.

The invention claimed is:

1. An integrated compressor and pump unit adapted for installation on a vehicle and adapted to draw rotary power from a power take-off shaft connected to a power source of the vehicle, the unit comprising:

a compressor unit comprising a compressor housing, rotary screws within the compressor housing for compressing a compressible fluid, a rotary input shaft coupled to one of the rotary screws and protruding from a first end of the compressor housing, and a rotary output shaft coupled to one of the rotary screws and protruding from a second end of the compressor housing opposite the first end thereof;

means for coupling the rotary input shaft of the compressor unit to the power take-off shaft of the vehicle, the coupling means comprising gearing to enable the rotary screws of the compressor unit to rotate at different speeds than the power take-off shaft;

a pump unit mounted to the second end of the compressor housing so as to define an interface between the compressor and pump units, the pump unit comprising a pump housing, rotary pumping means within the pump housing for pumping a second fluid, and a rotary input shaft coupled to the rotary pumping means;

means for securing the pump housing of the pump unit to the compressor housing of the compressor unit;

means located at the interface for transferring rotary motion of the rotary output shaft of the compressor unit to the rotary input shaft of the pump unit such that rotation of the coupling means directly causes rotation of the rotary input shaft of the compressor unit, rotation of the rotary output shaft of the compressor unit, compression of the compressible fluid by the rotary screws, rotation of the rotary input shaft of the pump unit, and pumping of the second fluid by the rotary pumping means; and means for fluidically sealing the compressible fluid within the compressor unit and the second fluid within the pump unit at the interface therebetween.

2. The integrated compressor and pump unit according to claim 1, wherein the securing means comprises a spacer between the pump housing and the compressor housing and the fluidic sealing means comprises a sealing element between the pump housing and the compressor housing, circumferentially surrounded by the spacer, and enclosed by the spacer, the pump housing, and the compressor housing.

3. The integrated compressor and pump unit according to claim 2, wherein the securing means comprises fasteners that pass through the spacer between the pump and compressor housings.

4. The integrated compressor and pump unit according to claim 1, wherein the transferring means comprises a shaft having a tapered end that frictionally fits into a tapered bore in an end of the rotary input shaft of the pump unit.

5. The integrated compressor and pump unit according to claim 1, wherein the integrated compressor and pump unit is installed on the vehicle and the coupling means is coupled to to the power take-off shaft of the vehicle to draw rotary power therefrom.

6. The integrated compressor and pump unit according to claim 5, wherein the integrated compressor and pump unit is installed on an undercarriage of the vehicle.

7. The integrated compressor and pump unit according to claim 5, wherein the power source comprises an internal combustion engine and the power take-off shaft is coupled thereto.

8. The integrated compressor and pump unit according to claim 5, wherein the vehicle is chosen from the group consisting of utility, service, emergency and military vehicles.

9. The integrated compressor and pump unit according to claim 1, further comprising means for introducing the compressible fluid from the compressor unit into the second fluid pumped by the pump unit.

10. The integrated compressor and pump unit according to claim 9, wherein the introducing means comprises a pilot valve assembly adapted to regulate the pressure of the compressible fluid compressed by the compressor unit relative to the pressure of the second fluid pumped by the pump unit.

11. The vehicle having the integrated compressor and pump unit according to claim 10.

12. An integrated air compressor and pump unit installed on a vehicle having an internal combustion engine and a power take-off shaft coupled thereto, the unit comprising:

an air compressor unit comprising a compressor housing, rotary screws within the compressor housing for compressing air, a rotary input shaft coupled to one of the rotary screws and protruding from a first end of the compressor housing, and a rotary output shaft coupled to one of the rotary screws and protruding from a second end of the compressor housing opposite the first end thereof;

means for coupling the rotary input shaft of the air compressor unit to the power take-off shaft of the vehicle, the coupling means comprising gearing to enable the rotary screws of the compressor unit to rotate at different speeds than the power take-off shaft;

a fluid pump unit mounted to the second end of the compressor housing so as to define an interface between the air compressor unit and the fluid pump unit, the fluid pump unit comprising a pump housing, rotary pumping means within the pump housing for pumping a fluid, and a rotary input shaft coupled to the rotary pumping means;

means for securing the pump housing of the fluid pump unit to the compressor housing of the air compressor unit;

means located at the interface for transferring rotary motion of the rotary input shaft of the air compressor unit to the rotary input shaft of the fluid pump unit such that rotation of the coupling means directly causes rotation of the rotary input shaft of the air compressor unit, compression of air by the rotary screws, rotation of the rotary input shaft of the fluid pump unit, and pumping of the fluid by the rotary pumping means; and means for fluidically sealing compressed air within the air compressor unit and the fluid within the fluid pump unit at the interface therebetween.

13. The integrated air compressor and pump unit according to claim 12, wherein the securing means comprises a spacer between the pump housing and the compressor housing and the fluidic sealing means comprises a sealing element between the pump housing and the compressor housing, circumferentially surrounded by the spacer, and enclosed by the spacer, the pump housing, and the compressor housing.

14. The integrated air compressor and pump unit according to claim 13, wherein the securing means comprises fasteners that pass through the spacer between the pump and compressor housings.

15. The integrated air compressor and pump unit according to claim 12, wherein the transferring means comprises a shaft having a tapered end that frictionally fits into a tapered bore in an end of the rotary input shaft of the pump unit.

16. The integrated air compressor and pump unit according to claim 12, wherein the integrated air compressor and pump unit is installed on an undercarriage of the vehicle.

17. The integrated air compressor and pump unit according to claim 12, wherein the vehicle is chosen from the group consisting of utility, service, emergency and military vehicles.

18. The integrated air compressor and pump unit according to claim 12, further comprising means for introducing compressed air from the air compressor unit into water pumped by the fluid pump unit.

19. The integrated air compressor and pump unit according to claim 18, wherein the introducing means comprises a pilot valve assembly adapted to regulate the pressure of the air compressed by the air compressor unit relative to the pressure of the water pumped by the fluid pump unit.

20. The vehicle having the integrated compressor and pump unit according to claim 19.

* * * * *